US005546605A

United States Patent [19]

Mallardi

[11] Patent Number: 5,546,605

[45] Date of Patent: Aug. 20, 1996

[54] PROTECTIVE STRAP COVER FOR A CAP

[76] Inventor: Maret L. Mallardi, 6 Saw Mill Rd., Cold Spring Harbor, N.Y. 11724

[21] Appl. No.: 490,772

[22] Filed: Jun. 15, 1995

Related U.S. Application Data

[63] Continuation-in-part of Ser. No. 114,652, Dec. 22, 1993, abandoned.

[51] Int. Cl.[6] ..... A42B 1/06

[52] U.S. Cl. ..... 2/209.13; 2/181; 2/181.4

[58] Field of Search ..... 2/21, 170, 181, 2/181.2, 181.4, 195.1, 195.2, 195.3, 195.4, 209.13, 452, DIG. 11; 40/329

[56] References Cited

U.S. PATENT DOCUMENTS 5,287,559 2/1994 Christiansen et al. ..... 2/209.13

5,315,714 5/1994 Peters et al. ..... 2/209.13

*Primary Examiner*—Diana Biefeld

*Attorney, Agent, or Firm*—Dilworth & Barrese

[57] ABSTRACT

The invention relates to a protective strap cover for a baseball-style cap for improving the comfort of fit between the strap assembly of the baseball-style cap and the head of the wearer. The protective strap cover includes first and second portions of flexible material connected to one another along parallel seam lines to define an elongated tubular structure configured to receive and enclose the first and second linear adjustable strap members of a baseball-style cap. At least one the portions of the flexible material is cushioned to provide a pad-like surface for contacting the hear of the wearer.

7 Claims, 2 Drawing Sheets

PROTECTIVE STRAP COVER FOR A CAP

This is a continuation-in-part of application Ser. No. 08/114,652, filed on 12/22/93, now abandoned.

BACKGROUND OF THE INVENTION

1. Field of the Invention

This invention relates to a protective strap cover for a baseball-style cap and more particularly to a tubular strap cover adapted to improve the comfort of the fit of between the sizing strap of a baseball-style cap and the head of the wearer.

2. Background of the Invention

As is well known, fastening straps have been utilized in conjunction with clothing and other apparel so as to fasten one portion of the apparel to another portion of the apparel. For example, baseball-style caps are provided with adjustable fastening straps so as to enable such baseball-style caps to be of a size which accommodates the hat size of the wearer. The aforementioned adjustable fastening straps are typically fabricated from plastic and have cooperating bosses on the engagement portions thereof to permit the respective straps to be disengageably fastened to one another for the purpose of sizing the cap to accommodate a specific wearer. However, when wearing the baseball-style cap in either a forward or backward orientation, the adjustable fastening strap is frequently uncomfortable when exposed to a bare forehead or to the back portion of the wearer's head or upper neck. Further, the adjustable fastening strap may become inadvertently detached due to the fact that the engagement portions of the respective straps are exposed permitting one of the straps to be caught so as to pull the cooperative engagement regions of the respective straps apart.

Therefore, there exists a need to improve the fit between the adjustable fastening strap of a baseball-style cap and the head of a wearer.

SUMMARY OF THE INVENTION

The present invention relates to a protective strap enclosure adapted to fit onto the adjustable fastening straps employed on a baseball-style cap to enable a comfortable fit when the baseball-style cap is fitted on the head of the wearer. Further, the protective strap enclosure prevents unwanted disengagement of the first and second selectively engageable linear members of the adjustable fastening strap assembly employed on a baseball-style cap.

The protective strap enclosure includes first and second portions of flexible material connected to one another. Preferably, the first and second portions are connected to one another along parallel seam lines so as to define an elongated tubular structure configured to receive and enclose the aforementioned first and second linear strap members. Further, at least one of the aforementioned portions of flexible material is cushioned to provide a pad-like surface for contacting the head of a wearer.

BRIEF DESCRIPTION OF THE DRAWINGS

The foregoing features of the present invention will become more readily apparent and may be understood by referring to the following detailed description of an illustrative embodiment of an apparatus according to the present invention, taken in conjunction with the accompanying drawings, in which.

DETAILED DESCRIPTION OF THE PREFERRED EMBODIMENTS

Figure 1:
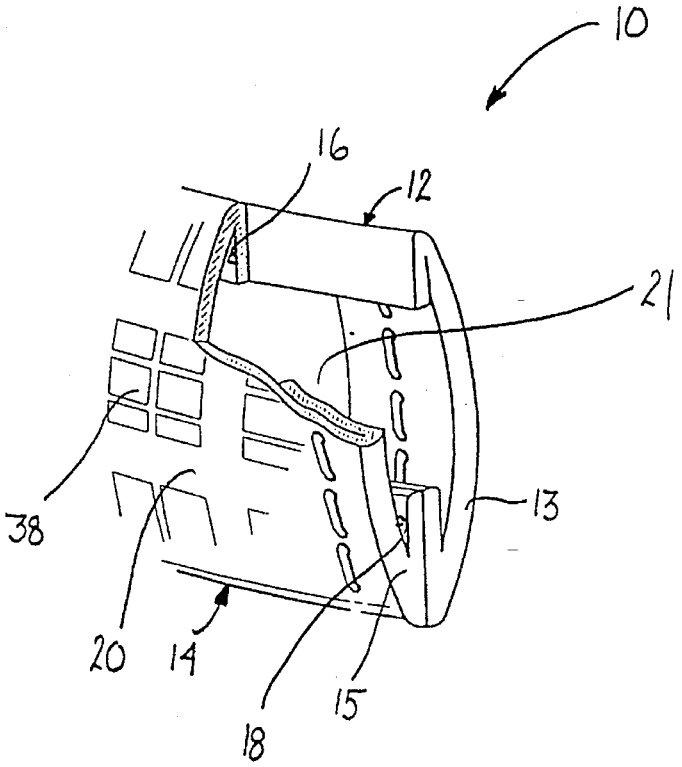
FIG. 1 is a perspective cutaway view of the protective strap enclosure in accordance with the present invention.
Figure 4:
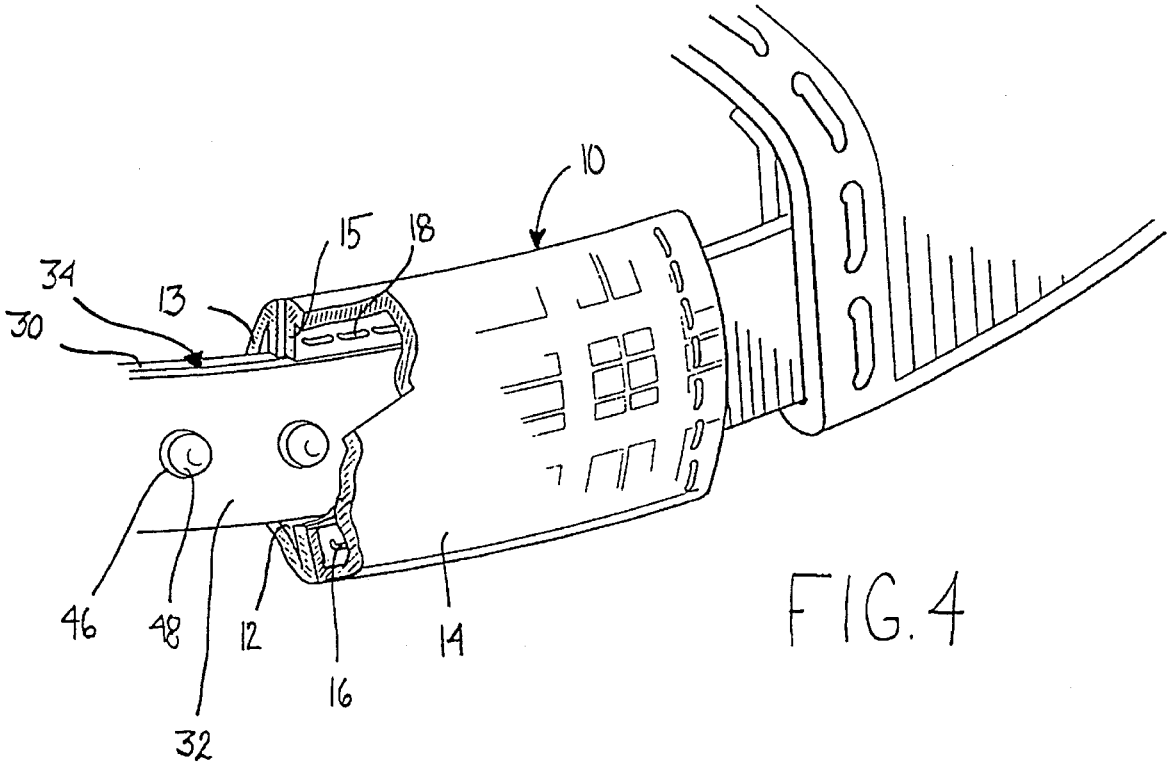
FIG. 4 is a perspective cutaway view of the protective strap attached to an assembled baseball-style adjustable strap assembly of FIG.4.

Referring now to the drawings in which like reference numerals identify similar structural elements of the subject invention there is illustrated in FIG. 1 a protective strap cover constructed in accordance with a preferred embodiment of the subject invention and designated generally by reference numeral 10. Protective strap cover 10 includes first and second portions 12, 14 preferably fabricated from a flexible material. The first and second portions 12 and 14 have similar dimensions. Preferably, each portion has a length of 5 ½" and a width of 1 ½". During fabrication, the first and second and portions are hemmed ½" at each end 13 and 15, making the length of each cover portion 4 ½". The two hemmed portions are sewn together by stitching along the lateral edges thereof to provide parallel seams 16 and 18 (FIG. 4). Alternatively, the edges may be glued or fixed to each other using fasteners such as staples, rivets, Velcro™ or any other fastener and/or suitable fastening technique with which such edges may be inexpensively and quickly fixed to each other. With the first and second flexible portions 12 and 14 affixed to one another, as described above, they define an elongated tubular structure which is 4 ½" in length by 1" wide.

Preferably, the aforementioned parallel seam lines 16, 18 are disposed within the tubular enclosure 21 defined by the elongated tubular structure 20. The disposure of the seam lines 16, 18 within the tubular enclosure 21 of the elongated tubular structure 20 is advantageous in that it functions to protect the seam lines 16, 18 from various elements associated with the outside environment which could potentially affect the destruction of seam lines 16 and 18. In the present preferred embodiment, the first flexible portion 12 is preferably fabricated from a cushioned material so as to provide a pad-like surface which contacts the head of the wearer when disposed on the adjustable strap assembly 34 (FIG. 2) of the baseball-style cap 36. Additionally, in the present preferred embodiment, the second flexible portion 14 is preferably provided with indicia 38 to increase the aesthetic appearance of the protective strap cover 10, as well as the baseball-style cap 36 when fitted on the head of the wearer. Further, the indicia may consist of safety oriented patterns and colors which function to increase the visibility of the wearer when engaged in such public activities as jogging.

Figure 2:
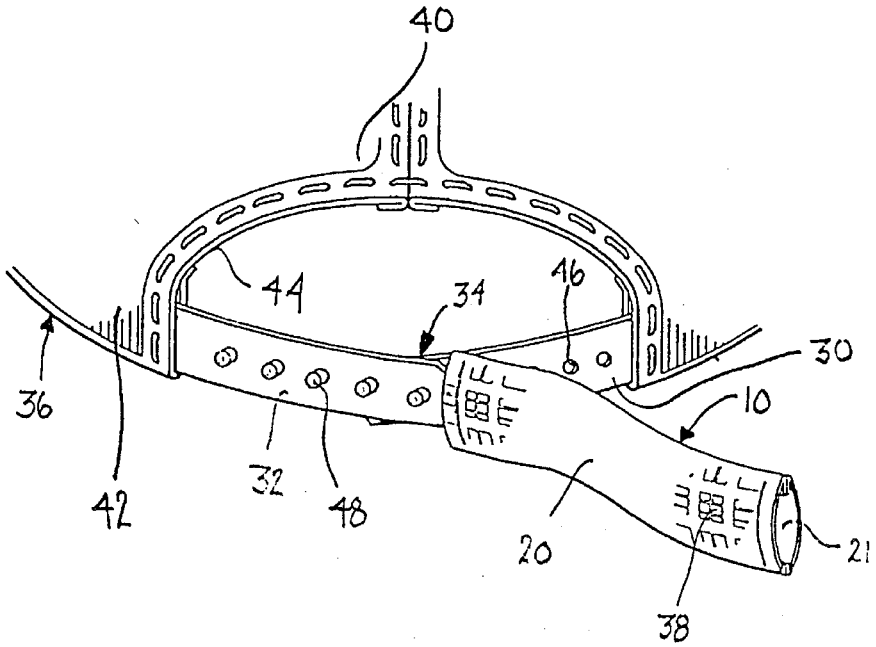
FIG. 2 is a perspective view of the protective strap enclosure of FIG. 1 disposed about one of the unassembled engageable linear members of a baseball-style cap adjustable strap assembly.
Figure 3:
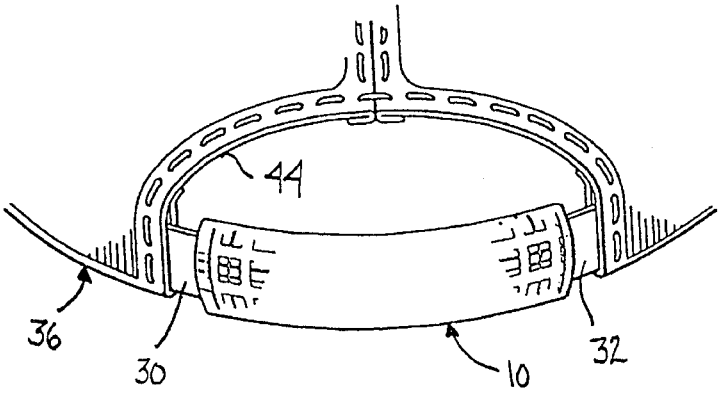
FIG. 3 is a perspective view of the protective strap enclosure attached to an assembled baseball-style adjustable strap assembly of FIG. 2.

Referring now to FIGS. 2 and 3, the above-described protective strap cover 10 is assembled onto the adjustable strap assembly 34 of the baseball-style cap 36 such that the strap cover 10 is disposed over selectively engageable first and second linear strap members 30, 32 associated with strap assembly 34. As shown in FIG. 2, the first and second linear strap members 30, 32 are each respectively attached to the baseball-style cap 36 having a normally frontal portion (not shown), a posterior portion 40, a top portion (not shown) and a bottom portion 42. The posterior portion 40 of the cap 36 has a generally inverted U-shaped opening 44 extending toward the bottom 42 of the cap 36. The first linear strap member 30 is attached to the cap 36 adjacent to the opening 44 at the bottom portion 42 and extends generally across the opening 44. The first linear strap member 30 is provided with a plurality of formed holes 46. The second linear strap member 32 is attached to the cap 36 adjacent the opening 44 at the bottom portion 42 of cap 36. The second linear strap member 32 is provided with a plurality of raised detents 48 which are dimensioned and configured to securely fit into the aforementioned holes 46 so as to provide a selectively interconnected fit when the cap 36 is fitted on the head of the wearer. It is to be appreciated that either of the linear strap members 30, 32 may be omitted and an engagement member such as a clip or other engagement member (not shown) may be attached to the cap for disengageably coupling the adjustable strap assembly 34.

Referring to FIG. 4 in conjunction with FIGS. 2 and 3, to apply the present invention strap cover 10 onto the adjustable strap assembly 34 a linear strap member (i.e. first linear strap member 30) is first slidably received within the tubular enclosure 21 defined by the protective strap cover 10. The strap cover 10 is then deformed to expose the plurality of formed holes 46 which, in turn, are selectively engaged with the plurality of raised detents 48 provided on the second linear strap member 32. Next, the protective strap cover 10 is adjusted so as to cover a substantial portion of the first and second linear strap covers 30, 32 providing a comfortable fit for the wearer of the baseball-style cap 36.

While the invention has been particularly shown and described with reference to certain preferred embodiments, it will be understood by those skilled in the art that various modifications in form and detail may be made therein without departure from the scope and spirit of the invention. Accordingly, modification to the preferred embodiments will be readily apparent to those skilled in the art, and the genetic principles defined herein may be applied to other embodiments without departing from the spirit and scope of the invention. Thus, the present invention is not intended to be limited to the embodiments shown, but it is to be accorded the widest scope consistent with the principles and features disclosed herein.

What is claimed is:

1. A strap enclosure for a hat having an adjustable strap assembly including first and second selectively engageable linear members, said strap enclosure comprising:

first and second portions of flexible material connected to one another along parallel seam lines to define an elongated tubular structure configured to receive and enclose said first and second linear strap members, at least one of said portions of flexible material being cushioned to provide a pad-like surface for contacting the head of a wearer.

2. A strap enclosure for a hat having an adjustable strap assembly as recited in claim 1, wherein said parallel seam lines are disposed within a tubular enclosure defined by said elongated tubular structure.

3. A strap enclosure for a hat having an adjustable strap assembly as recited in claim 1, wherein at least one of said portions of flexible material is provided with predetermined indicia thereon.

4. A strap enclosure and cap combination comprising:

(a) a cap having a front portion and a posterior portion, a top and bottom portion and wherein said posterior portion is provided having a generally inverted U-shaped opening extending toward said bottom of said cap;

(b) an adjustable strap assembly associated with said U-shaped opening, said adjustable strap assembly including;

(i) a first linear strap member attached to said cap adjacent said U-shaped opening, said first linear strap member having a first engagement region; and (ii) a second linear strap member adjacent said U-shaped opening and opposite said first linear strap member, and extending generally across said U-shaped opening towards said first linear strap member, said second linear strap member having a second engagement region configured to selectively interconnect with said first engagement region; and (c) a strap enclosure having first and second portions of flexible material connected to one another along parallel seam lines to define an elongated tubular structure configured to receive and enclose said first and second linear strap members, at least one of said portions of flexible material being cushioned to provide a pad-like surface for contacting the head of a wearer.

5. A strap enclosure and cap combination as recited in claim 4, wherein said parallel seam lines are disposed within a tubular enclosure defined by said strap assembly.

6. A strap enclosure and cap combination as recited in claim 4, wherein at least one of said portions of flexible material is provided with predetermined indicia thereon.

7. A strap enclosure and cap combination as recited in claim 4, wherein said first engagement region is provided with a plurality of holes and said second engagement region is provided with a plurality of raised detents configured to selectively interconnect with said plurality of holes of said first engagement region.

* * * * *